US007438128B2

(12) United States Patent
Drozd et al.

(10) Patent No.: US 7,438,128 B2
(45) Date of Patent: Oct. 21, 2008

(54) IDENTIFYING ZONES OF ORIGIN OF ANNULAR GAS PRESSURE

(75) Inventors: Richard J. Drozd, Katy, TX (US); Louis W. Elrod, Houston, TX (US); Patrick Jacobs, Shenandoah, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 153 days.

(21) Appl. No.: 11/122,159

(22) Filed: May 4, 2005

(65) Prior Publication Data

US 2006/0249288 A1 Nov. 9, 2006

(51) Int. Cl.
*E21B 47/00* (2006.01)
*E21B 47/10* (2006.01)

(52) U.S. Cl. ..... 166/254.1; 166/250.07; 166/264; 73/152.19; 73/152.22; 73/152.23; 73/152.27; 175/50; 702/9

(58) Field of Classification Search ..... None
See application file for complete search history.

(56) References Cited

U.S. PATENT DOCUMENTS 3,033,287 A * 5/1962 Bond ..... 166/250.16
4,235,291 A * 11/1980 Messenger ..... 166/292
4,266,277 A 5/1981 Issenmann ..... 364/498
4,635,735 A 1/1987 Crownover ..... 175/48
4,887,464 A 12/1989 Tannenbaum et al. ..... 73/153
5,006,845 A 4/1991 Calcar et al. ..... 340/853
5,199,509 A 4/1993 Wright et al. ..... 175/50
5,469,917 A 11/1995 Wolcott ..... 166/250.01
7,337,660 B2 * 3/2008 Ibrahim et al. ..... 73/152.55
2003/0160164 A1 8/2003 Jones et al. ..... 250/269.1
2004/0164237 A1 8/2004 Jones et al. ..... 250/269.1
2005/0256647 A1 * 11/2005 Ellis ..... 702/9

OTHER PUBLICATIONS

"annular gas flow" Schlumberger Oilfield Glossary, retrieved from http://www.glossary.oilfield.slb.com/search.cfm.*
Schlumberger Oilfield Glossary, "annulus," retrieved from http://www.glossary.oilfield.slb.com/search.cfm.*

* cited by examiner

*Primary Examiner*—Jennifer H Gay
*Assistant Examiner*—Angela M DiTrani
(74) *Attorney, Agent, or Firm*—Craig W. Roddy; Conley Rose, P.C.

(57) ABSTRACT

A method for identifying annular gas sources in a wellbore is disclosed. In one embodiment, the method comprises providing a set of parameters, wherein the set of parameters corresponds to depths in the wellbore. In addition, the method comprises analyzing annular gas in the wellbore to provide isotopic data of the annular gas. The method further comprises correlating the isotopic data to the set of parameters to identify the annular gas source.

23 Claims, 2 Drawing Sheets

IDENTIFYING ZONES OF ORIGIN OF ANNULAR GAS PRESSURE

BACKGROUND OF THE INVENTION

1. Field of the Invention

This invention relates to the field of analyzing wellbore gases and more specifically to the field of analyzing annular gas to identify the annular gas zone of origin.

2. Background of the Invention

A natural resource such as oil or gas residing in a subterranean formation can be recovered by drilling a well into the formation. The subterranean formation is usually isolated from other formations using a technique known as well cementing. In particular, a wellbore is typically drilled down to the subterranean formation while circulating a drilling fluid through the wellbore. After the drilling is terminated, a string of pipe, e.g., casing, is run in the wellbore. Primary cementing is then usually performed whereby a cement slurry is pumped down through the string of pipe and into the annulus between the string of pipe and the walls of the wellbore to allow the cement slurry to set into an impermeable cement column and thereby seal the annulus. Secondary cementing operations may also be performed after the primary cementing operation. One example of a secondary cementing operation is squeeze cementing whereby a cement slurry is forced under pressure to areas of lost integrity in the annulus to seal off those areas.

After the well is completed, the pressure of gas in the annulus of the well (referred to as annular gas) is typically monitored. Annular gas pressure is a concern in wells. For instance, sustained annular gas pressure may increase to pressures that cause safety issues in active and abandoned wells. The gas that causes high annular gas pressures may originate and enter the annulus from any depth and zone in the well. As the gas enters the annulus, it may migrate up through the well to its surface and thereby increase the pressure in the annulus. As an example, the gas may migrate through old or damaged cement jobs to the surface of the well. Conventional methods for mitigating the annular gas pressure include testing gas at the surface of the well to determine its chemical composition. The chemical composition of the gas is then correlated to well logs to determine the origin of the gas. Drawbacks to the conventional methods include instances in which the chemical composition of the gas is insufficient to associate the annular gas with a specific zone in the well. For example, in some instances, the well logs containing chemical compositions of the mud gas found in wellbore zones do not have sufficient variances in compositions to identify the zone of origin. For instance, the chemical composition of hydrocarbon gases in a wellbore typically include carbon dioxide, nitrogen, methane, ethane, propane, iso- and normal butane, iso- and normal pentane, and sulfur gases, which are components analyzed in determining the origin of the gas. However, the content of heavier hydrocarbons typically varies slightly, which may reduce the number of available parameters in the annular gas suitable for correlating to the well logs. Further drawbacks include the time involved in determining the chemical composition and making a sufficient correlation to identify the zone of origin.

Consequently, there is a need for a more efficient method in identifying the zone of origin of annular gas. In addition, there is a need for monitoring annular gas pressure and identifying the zone of origin of annular gas in real-time. Further needs include improved methods for mitigating annular gas pressure.

BRIEF SUMMARY OF SOME OF THE PREFERRED EMBODIMENTS

These and other needs in the art are addressed in one embodiment by a method for identifying an annular gas source in a wellbore. The method comprises providing a set of parameters, wherein the set of parameters corresponds to depths in the wellbore. In addition, the method comprises analyzing annular gas in the wellbore to provide isotopic data of the annular gas. The method further comprises correlating the isotopic data to the set of parameters to identify the annular gas source.

In another embodiment, these and other needs in the art are addressed in one embodiment by a method for mitigating annular pressure in a wellbore. The method comprises analyzing mud gas in the wellbore during drilling to provide a set of isotopic parameters that correspond to depths in the wellbore. In addition, the method comprises analyzing annular gas in the wellbore to provide isotopic data of the annular gas, and correlating the isotopic data to the isotopic parameters to identify the source of the annular gas. The method further comprises reducing annular gas pressure.

Isotopic analysis of annular gas to mitigate annular gas pressure overcomes problems in the art such as identifying the zones of origin of the annular gas. For instance, the zones of origin may be determined in real-time by isotopically analyzing the annular gas. In addition, isotopic analysis of the annular gas allows for the identification of the depth at which the gas originates.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
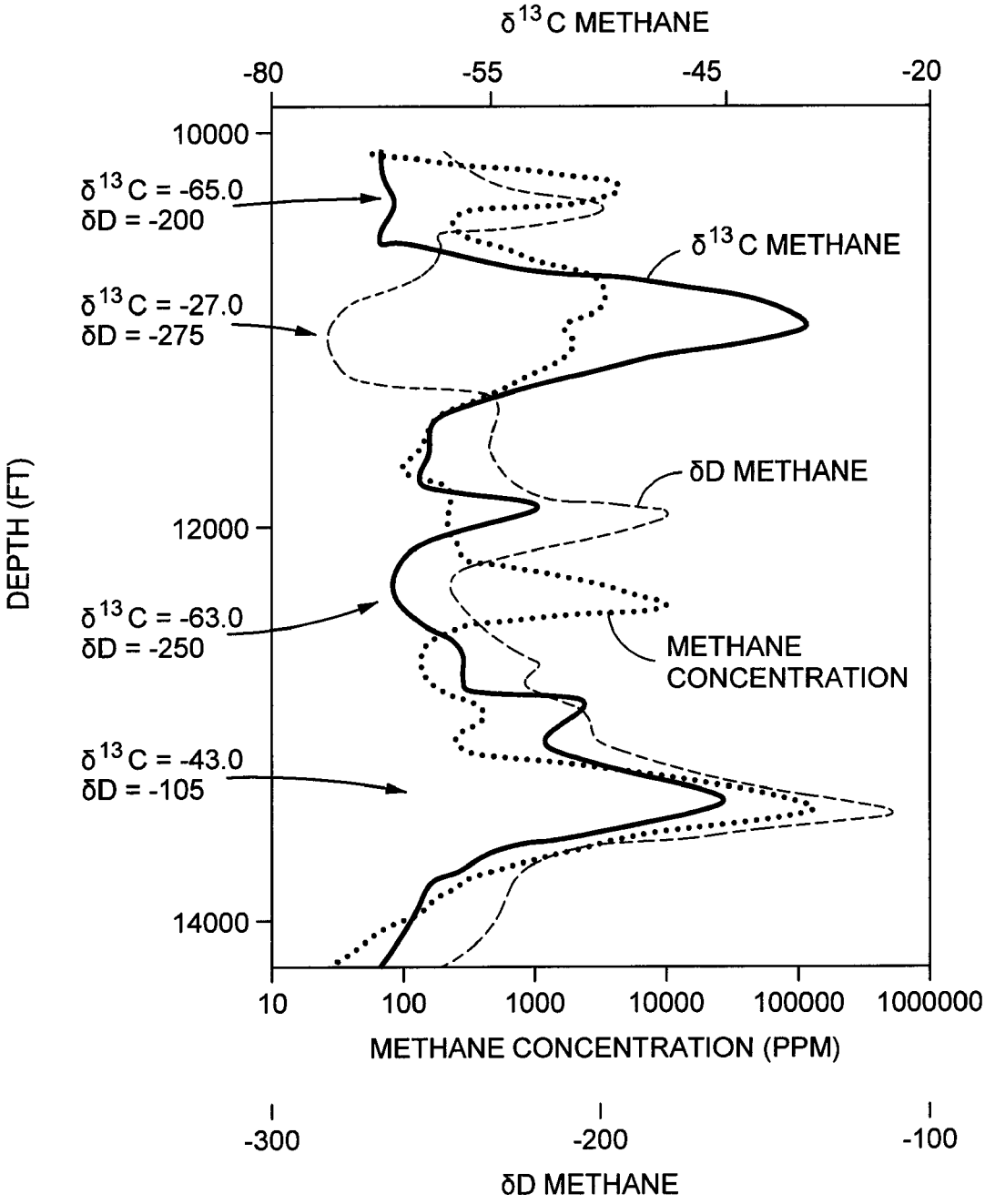
FIG. 1 illustrates an example of a well profile.

In an embodiment, annular gas in a wellbore is analyzed, and the results are correlated to a set of reference parameters to identify the source of the annular gas. By identifying the source of the annular gas, pressure accumulation in the annulus may be mitigated. Analyzing the annular gas includes measuring isotopic data of the annular gas. In an embodiment, the set of reference parameters includes a set of reference isotopic data related to gases in the wellbore. Correlating the measured isotopic data to the reference isotopic data allows the zone of origin of the annular gas source to be identified. For instance, parameters in the measured isotopic data can be correlated to similar parameters in the set of reference isotopic data to identify the depth and thereby the zone of origin of the annular gas. Without being limited by theory, the correlation can identify the zone of origin because isotopic data of compounds in wellbore gas may sufficiently vary with thermal maturity to identify the proper zone. Therefore, the depth at which the annular gas originates may be identified by correlating measured isotopic data to the set of reference isotopic data.

The wellbore may be a wellbore that penetrates a subterranean formation. It is to be understood that "subterranean formation" encompasses both areas below exposed earth and areas below earth covered by water such as an ocean or fresh water.

In an embodiment, the measured isotopic data relates to annular gas, and the set of reference isotopic parameters relates to gases sampled at different locations or depths in the wellbore, for example mud gases sampled during drilling of the well. It is to be understood that wellbore gas refers to both annular gas and gas sampled at or corresponding to different locations in the wellbore (e.g., mud gas). The measured isotopic data and reference isotopic data for wellbore gases include such isotopic data as isotopic composition, isotopic ratio, isotopic concentration, or combinations thereof. In some embodiments, the isotopic data can be related to individual gaseous compounds in the wellbore gas. For instance, the isotopic data can relate to isotopes in any compounds found in wellbore gas such as without limitation carbon dioxide, methane, ethane, propane, butane, pentane, or combinations thereof. In an embodiment, the isotopic data relates to isotopes in methane, ethane, carbon dioxide, or combinations thereof. In other embodiments, the isotopic data relates to isotopes in methane, ethane, or combinations thereof. In an embodiment, the isotopes are carbon isotopes such as $^{13}C$, hydrogen isotopes such as deuterium (D), or combinations thereof.

Isotopic composition refers to the composition of isotopes contained in the individual compounds of the wellbore gas. For instance, isotopic composition includes the composition of carbon and/or hydrogen isotopes in individual compounds such as methane and ethane. Isotopic ratio refers to the ratio of isotopes in the wellbore gas. Without limitation, examples of isotopic ratios include $^{13}C/^{12}C$ ratios in compounds such as in methane and ethane; D/H ratios in compounds such as in methane and ethane; ratios of individual isotopic compounds such as $^{13}CH_4/^{12}CH_4$ and $^{13}C^{12}CH_6/^{12}C_2H_6$; and the like. Isotopic concentration refers to the concentration of isotopic compounds in the wellbore gas. Without limitation, examples of isotopic concentration include the concentration of $^{13}CH_4$, $^{13}C^{12}CH_6$, and the like in wellbore gas.

Isotopic data of wellbore gases can be measured by any suitable method. Without limitation, examples of suitable methods for taking isotopic measurements are disclosed in U.S. Patent Application Publication Nos. 2003-0160164 and 2004-0164237, which are both incorporated herein by reference in their entirety. A commercial example of a suitable device for measuring isotopic data of wellbore gases includes without limitation the ARMIS well site isotope service, which is available from Westport Technology Center International and is a gas characterization device and service that provides real-time gas isotope analysis.

In alternative embodiments, the annular gas is measured to determine its chemical composition as well as the isotopic data. In such an embodiment, the set of reference parameters may also include reference chemical composition data of gas sampled during logging of the wellbore. For instance, the presence and concentration of carbon dioxide, nitrogen, methane, ethane, propane, iso- and normal butane, iso- and normal pentane, and sulfur in the wellbore gas is measured and the results correlated. In an embodiment, the presence and concentration of methane, ethane, and carbon dioxide in the wellbore gas is measured and the results correlated. In other embodiments, the presence and concentration of methane and ethane in the wellbore gas is measured and the results correlated. The chemical composition may be measured by any suitable method such as by gas chromatograph. In addition to isotopic correlation, the measured chemical composition data for the annular gas is correlated to the reference chemical composition data from gas located at various depths in the wellbore. The isotopic correlation alone or in combination with the chemical composition correlation allows for identification of the zone of origin of the annular gas.

In an embodiment, the set of reference parameters includes isotopic data of gas that corresponds to depths in the wellbore. The set of reference parameters may be obtained by any suitable source. For instance, the set of reference parameters may be obtained and logged while drilling the wellbore, from an offset well or wells, from known data such as data from similar wells, inferred by computer modeling, or combinations thereof. In embodiments wherein the isotopic data is obtained while drilling the well, the hydrocarbon gases encountered as the well is being drilled (e.g., mud gases) are analyzed to obtain isotopic data. The isotopic data is recorded along with the corresponding depth at which the gas originated. By relating isotopic data of the mud gas to the corresponding wellbore depth, the gases encountered in the wellbore may be characterized, and a wellbore profile of isotopic parameters corresponding to wellbore depths may be obtained. In embodiments wherein the set of parameters is obtained from an offset well, the offset well may be one with similar characteristics to the desired well.

FIG. 1 illustrates an example of a well profile from 12,000 ft to 14,000 ft. For instance, it illustrates four gas shows, which include intervals with elevated methane concentration as indicated by the dotted line. A gas show refers to an elevation in the concentration of methane in the drilling mud that is observed as an elevation in the concentration of methane and higher hydrocarbons in the mud gas during drilling. A gas show may indicate the presence of an accumulation of hydrocarbons in the stratum being penetrated when the show is observed. As shown, each of the four shows has different values for the combination of $\delta^{13}C$ (solid line) and $\delta D$ (dashed line). Therefore, if one interval were leaking gas into the annulus of a well, the identity of the interval may be ascertained by evaluation of the isotope data.

In alternative embodiments, the set of reference parameters may further include the chemical composition of the gases at corresponding wellbore depths. Likewise, the chemical composition may also be obtained while drilling the wellbore; from an offset well or wells; from sidetrack well or wells; from known data such as data from similar wells; from computer modeling of the geologic, geochemical and/or burial history; or combinations thereof. In an embodiment, the chemical composition is obtained from mud gases while the well is being drilled.

In an embodiment, the annular gas is isotopically analyzed and optionally chemically analyzed. The annular gas may be analyzed at any desired time. For instance, the annular gas may be periodically analyzed at desired intervals. In some embodiments, the annular gas is measured in instances when the annular pressure reaches a desired pressure. The annular pressure may be monitored by any desired method. For example, a suitable method for measuring the annular pressure is by a well annulus monitor such as a pressure gauge located on the annulus. In some embodiments, the annular gas is analyzed in instances when the annular pressure is sustained at or above a pressure for a period of time.

In an embodiment, the measured data (e.g., measured isotopic data and optionally measured chemical composition data) resulting from analysis of the annular gas is correlated to the set of reference parameters (e.g., reference isotopic data and optionally reference chemical composition data) to determine the zone of origin of the annular gas. The correlation may be accomplished by any suitable method. For instance, the correlation can be accomplished through inspection of the measured data and the set of reference parameters. In other embodiments, software can correlate the measured data to the set of reference parameters. It is to be understood that all of the reference data related to the annular gas is not required to be compared to the set of reference parameters. Instead, a sufficient portion of the reference data may be compared to the set of reference parameters to suitably identify the zone of origin of the annular gas. In alternative embodiments, substantially all of the reference data is correlated to the set of reference parameters. In an embodiment, all or a portion of the measured isotopic data, all or a portion of the measured chemical composition data, or combinations thereof are correlated to a corresponding set of reference data to determine the zone of origin of the annular gas. It is to be further understood that identification of the zone of origin includes identifying the zone in the wellbore profile of reference parameters that most closely corresponds (e.g., has the most similar parameters such as isotopic ratios, isotopic composition, isotopic concentration, chemical composition, or combinations thereof) to the measured data of the annular gas. In some embodiments, the correlation may identify more than one zone of origin. In such embodiments, the identity of the zone and the quantity of gas from each zone may be determined by appropriate statistical treatment of the measured values for the gas. Without limitation, examples of such treatments include principle component analysis, cluster analysis, and linear and non-linear regressions. For such treatment, the values for the wellbore may provide end-member values for each zone. An end-member value refers to parameter values for the unmixed or "pure" gas from an individual hydrocarbon zone or accumulation.

In some embodiments, computer systems using software may compare the measured data to the set of reference parameters and identify the source of the annular gas. The computer analysis may identify the zone of origin in real-time. Real-time refers to the time in which a physical process under computer control occurs (e.g., from the time the software is fed the annular gas analysis results to the time the annular gas source is identified).

In an embodiment, the annular gas pressure composition (isotopic and/or chemical), or both are monitored remotely, preferably in real time. For example, a pressure sensor, isotopic analyzer, chemical analyzer, or combinations thereof may be operatively coupled to a well (e.g., a wellhead) to sense pressure and analyze the annular gas. The resultant measured data may be recorded locally (e.g., saved on computer media or printed out) or may be transmitted (e.g., via wire or wireless) to a location remote from the well. The transmitted resultant measured data may include the identity of the annular gas source and/or the isotopic data. In an embodiment, the invention of the present disclosure is employed on one or more offshore platforms (e.g., manned or unmanned platform, some of which may serve numerous wells), whereby annular gas data can be centrally monitored for a number of wells.

Figure 2:
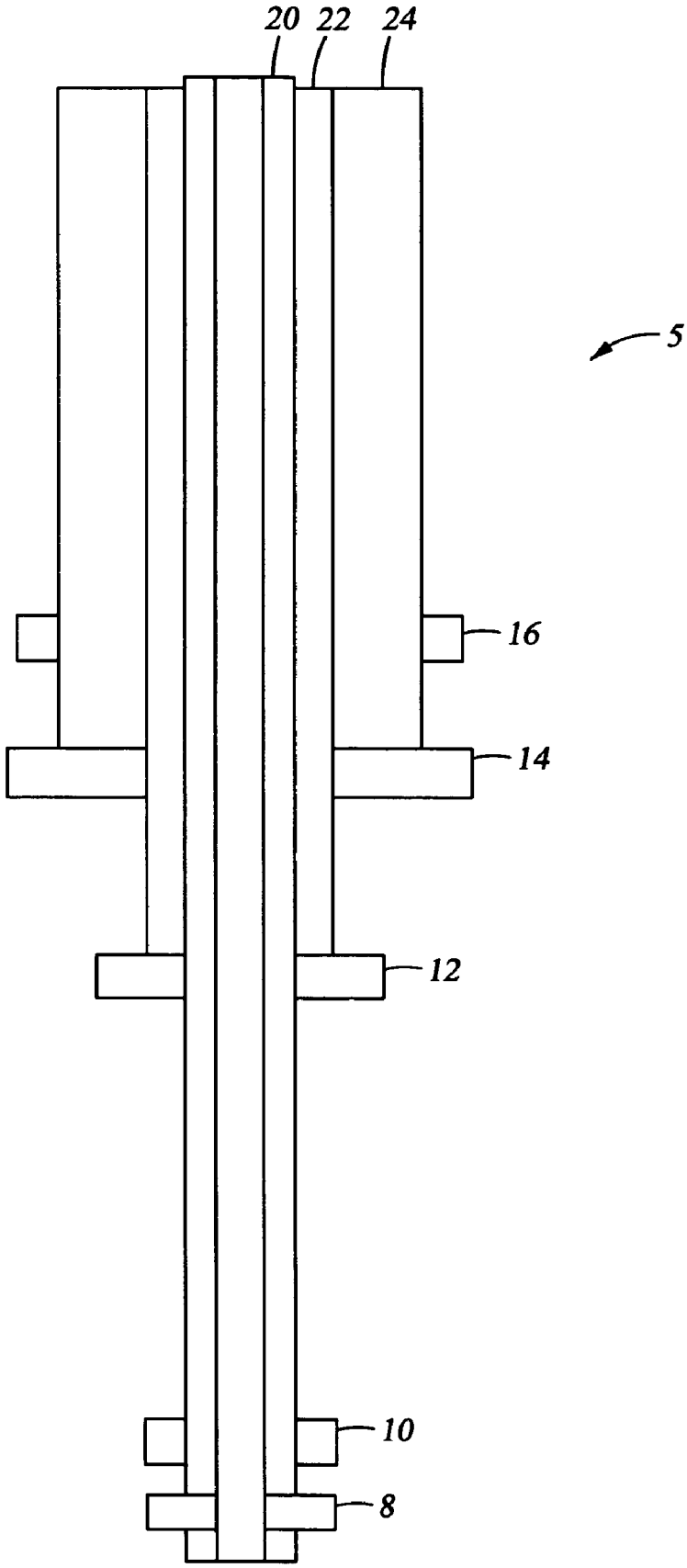
FIG. 2 illustrates potential sources of annular gas for a wellbore.

It is to be understood that a typical well contains multiple potential sources of annular gas. Examples of annular gas sources include the cement column residing in the annulus, a wall of the conduit in the wellbore, a microannulus between the cement column and the subterranean formation, a microannulus between the cement column and the conduit, and/or a microfracture within the cement. For instance, FIG. 2 illustrates an example of a wellbore 5 having multiple potential sources (e.g., at casing points 12 and 14 and perforations 10 and 16) of annular gas located above casing perforations 8. For such an illustrative wellbore 5, samples of annular gas may be taken at appropriate locations in wellbore 5 and analyzed. Appropriate locations for taking samples can be any suitable locations in the annulus for taking annular gas samples. In some embodiments, the samples are taken at the top of the annulus, for example as represented by annular sample points at the top of individual cement jobs such as 20, 22, and 24 in FIG. 2. In an embodiment, the annular gas is sampled in a head space at the top of the well. The samples taken are analyzed for isotopic data, and in alternative embodiments are analyzed for chemical composition as well, and correlated to a set of reference parameters (e.g., profile of the well). The wellbore zone identified in the profile with corresponding parameters that are most similar to the isotopic data of the annular gas is identified as the source of the annular gas.

Once the source of the annular gas is identified, pressure accumulation in the annulus may be mitigated. The pressure accumulation may be mitigated by any suitable method. For instance, the pressure accumulation may be mitigated by injecting a sealant or by squeeze cementing one or more sources of annular gas such as microannuli or microfractures. Squeeze cementing is an example of a secondary cementing operation, which occurs after primary cementing operations are complete. In squeeze cementing, a cement composition comprising water and cement is forced under pressure into the zone of origin of the annular gas. The cement composition sets within the zone, thereby forming a hard mass to plug the zone and prevent gas from leaking therethrough. The flow of gas from the zone of origin to the annulus is reduced, and pressure accumulation is mitigated.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method for identifying an annular gas source in a wellbore, comprising:

providing a set of reference parameters, wherein the set of reference parameters corresponds to depths in the wellbore;

analyzing annular gas in the wellbore to provide isotopic data of the annular gas, wherein the annular gas is generated between a wellbore wall and a casing, a cement, or both;

correlating the isotopic data to the set of reference parameters to identify the annular gas source.

2. The method of claim 1, wherein the set of reference parameters is provided by characterizing mud gas in the wellbore while drilling the wellbore.

3. The method of claim 1, wherein the isotopic data and the set of reference parameters relate to gaseous compounds.

4. The method of claim 3, wherein the gaseous compounds comprise methane, ethane, or combinations thereof.

5. The method of claim 1, wherein the isotopic data and the set of reference parameters comprise isotopic composition, isotopic ratio, isotopic concentration, or combinations thereof.

6. The method of claim 5, wherein the isotopic composition comprises the composition of carbon isotopes, hydrogen isotopes, or combinations thereof in individual gaseous compounds.

7. The method of claim 6, wherein the carbon isotopes comprise $^{13}C$.

8. The method of claim 6, wherein the hydrogen isotopes comprise deuterium.

9. The method of claim 5, wherein the isotopic ratio comprises the ratio of carbon isotopes in individual gaseous compounds, the ratio of hydrogen isotopes in individual gaseous compounds, the ratio of individual isotopic compounds, or combinations thereof.

10. The method of claim 5, wherein the isotopic concentration comprises the concentration of individual gaseous compounds.

11. The method of claim 1, wherein correlating the isotopic data to the set of parameters is accomplished in real-time.

12. The method of claim 1, further comprising transmitting the isotopic data, the identity of the annular gas source, or both to a location remote from the wellbore.

13. The method of claim 1, wherein the set of reference parameters further comprises chemical composition parameters, and further wherein analyzing annular gas provides chemical composition data, the method further comprising correlating the chemical composition data to the set of reference parameters to identify the annular gas source.

14. The method of claim 1, further comprising identifying the depth in the wellbore at which the annular gas source is located.

15. The method of claim 1, further comprising squeeze cementing a wellbore zone comprising the annular gas source.

16. The method of claim 1, further comprising mitigating pressure accumulation in an annulus of the wellbore.

17. The method of claim 1, wherein the isotopic data is a first set of isotopic data, and wherein the reference parameters comprise a second set of isotopic data.

18. A method for mitigating annular pressure in a wellbore, comprising:

developing a set of reference parameters comprising a first set of isotopic data that correspond to depths in the wellbore;

analyzing annular gas in the wellbore to provide a second set of isotopic data of the annular gas;

correlating the second set of isotopic data to the set of reference parameters to identify the source of the annular gas; and servicing the identified source of the annular gas to reduce the amount of annular gas and associated pressure.

19. The method of claim 18, wherein the isotopic data and the set of reference parameters comprise isotopic composition, isotopic ratio, isotopic concentration, or combinations thereof.

20. The method of claim 18, wherein the isotopic data and set of reference parameters comprise carbon isotopes, hydrogen isotopes, or combinations thereof.

21. The method of claim 18, wherein analyzing the annular gas and identifying the source of the annular gas are accomplished in real-time.

22. The method of claim 18, wherein the set of reference parameters further comprises chemical composition parameters, and further wherein analyzing annular gas provides chemical composition data, the method further comprising correlating the chemical composition data to the set of reference parameters to identify the annular gas source.

23. The method of claim 18, wherein the annular gas is generated between a wellbore wall and a casing, a cement, or both.

* * * * *